US005093603A

United States Patent [19]

Kim et al.

[11] Patent Number: 5,093,603

[45] Date of Patent: Mar. 3, 1992

[54] PLASMA DISPLAY PANEL

[75] Inventors: Seong-hun Kim; Weon-taek Park, both of Seoul, Rep. of Korea

[73] Assignee: Samsung Electron Devices Co. Ltd., Seoul, Rep. of Korea

[21] Appl. No.: 627,464

[22] Filed: Dec. 14, 1990

[30] Foreign Application Priority Data

Jul. 31, 1990 [KR] Rep. of Korea ..... 90-11786

[51] Int. Cl.[5] ..... H01J 17/49

[52] U.S. Cl. ..... 313/586; 313/585; 313/584

[58] Field of Search ..... 313/581, 582, 584, 586, 313/585, 306, 307, 308, 485; 340/771, 773, 775

[56] References Cited

U.S. PATENT DOCUMENTS 4,999,541 3/1991 Kim et al. ..... 313/584

FOREIGN PATENT DOCUMENTS 0037634 3/1984 Japan ..... 313/582

60-193235 10/1985 Japan .

*Primary Examiner*—Donald J. Yusko

*Assistant Examiner*—N. D. Patel

*Attorney, Agent, or Firm*—Rothwell, Figg, Ernst & Kurz

[57] ABSTRACT

A plasma display panel (PDP) driven by a pulse memory type driving method. In the PDP, a display anode array is arranged on the inner surface of a rear plate to increase the effective light emission area, and a path of charged gas particles from an auxiliary cell to a display cell is formed along the rear plate to enhance the contrast ratio. As a result, high brightness and high contrast ratio can be obtained.

4 Claims, 2 Drawing Sheets

PLASMA DISPLAY PANEL

FIELD OF THE INVENTION

The present invention relates to a plasma display panel, and particularly to a plasma display panel with high brightness.

BACKGROUND OF THE INVENTION

In a conventional plasma display panel (hereinafter referred to as "PDP") of the pulse memory type, in addition to display discharge cells, auxiliary discharge cells are needed for rapid and accurate display within a short time.

An example of the above mentioned conventional PDP is disclosed in Japanese Patent Publication No. 60-193235, which is shown as a partially sectional view in FIG. 1, and a cross sectional view in FIG. 2. In the drawings, display cathode array 11 is formed on rear glass plate 10, and latticed barrier ribs 15 are formed thereon to form discharge cell spaces. Meanwhile, display anode array 13 and auxiliary anode array 14 are formed on the inner surface of a face plate 20. The display and auxiliary anode arrays 13 and 14 are disposed at the respective center between barrier ribs 15 so as to face and intersect with the corresponding display cathodes of the display cathode array 11. Then, discharging gas is injected into the panel under a certain vacuum state, and the peripherals of plates 10 and 20 are sealed together as shown in FIG. 2. Numeral 16 indicates a light cutoff layer for maintaining the brightness of a dark level at a sufficiently low value by blocking light given off by the auxiliary discharge.

However, in the conventional PDP constructed as described above, since all the display anodes are formed on the face plate, the effective light emission area is decreased which results in a lower brightness. In particular, since the plurality of display cells are simultaneously turned on by the memory function of the pulse memory driving system, a large amount of current flows within the display anodes, and thus there may be a problem that all the display cells corresponding to the display anodes are simultaneously discharged in the extreme case. Therefore, the display anodes are required to be formed relatively wide for supplying large currents. But in this case, because the display anodes are arranged on the inner surface of the face plate, the wide display anodes block the discharged light generated from the display cells, thereby even further reducing the effective light emission area. As a result, the brightness becomes further deteriorated.

Moreover, by the fact that the discharge initiation voltage depends on the distance between each display anode and cathode, the distance between each anode and cathode should be maintained within a predetermined range for achieving a stable memory function without erroneous operation. However, the larger size of the panel causes a greater variation of the distance between the display anodes and the cathode array, and thus it is impossible to obtain overall stable memory operation.

Furthermore, because all the paths of charged gas particles from the auxiliary discharge space to the display discharge space are formed at the upper portion of the discharge space, it causes a problem that the light emitted by the auxiliary discharge leaks into the discharge cell region, thereby decreasing the contrast ratio.

SUMMARY OF THE INVENTION

Accordingly, it is an object of the present invention to provide a PDP in which high brightness and high contrast ratio can be achieved by forming a display anode array on the inner surface of a rear plate, and the paths of charged gas particles at the lower portion of a discharge space.

To achieve the object, there is provided a PDP including a rear plate; a face plate; a display cathode array arranged as elongated electrode strips on the inner surface of the rear plate; a plurality of dielectric layers having a prescribed width on the inner surface of the rear plate and arranged to intersect the cathode array at a right angle; an auxiliary anode array formed as elongated electrode strips oppose to and intersect the cathode array at a right angle, and further comprising:

an array of pairs of display anodes as strips formed to intersect the cathode array at a right angle on each of the dielectric layers; and a plurality of latticed barrier ribs formed in a lattice arrangement for forming display discharge cells and auxiliary discharge cells on the inner surface of the face plate having the auxiliary anode array, the barrier ribs having paths of charged gas particles of a thickness the same as that of the dielectric layer at the lower portion of discharge space.

BRIEF DESCRIPTION OF THE DRAWINGS

The present invention will be described in detail with reference to accompanying drawings, in which.

DETAILED DESCRIPTION OF THE INVENTION

Figure 1:
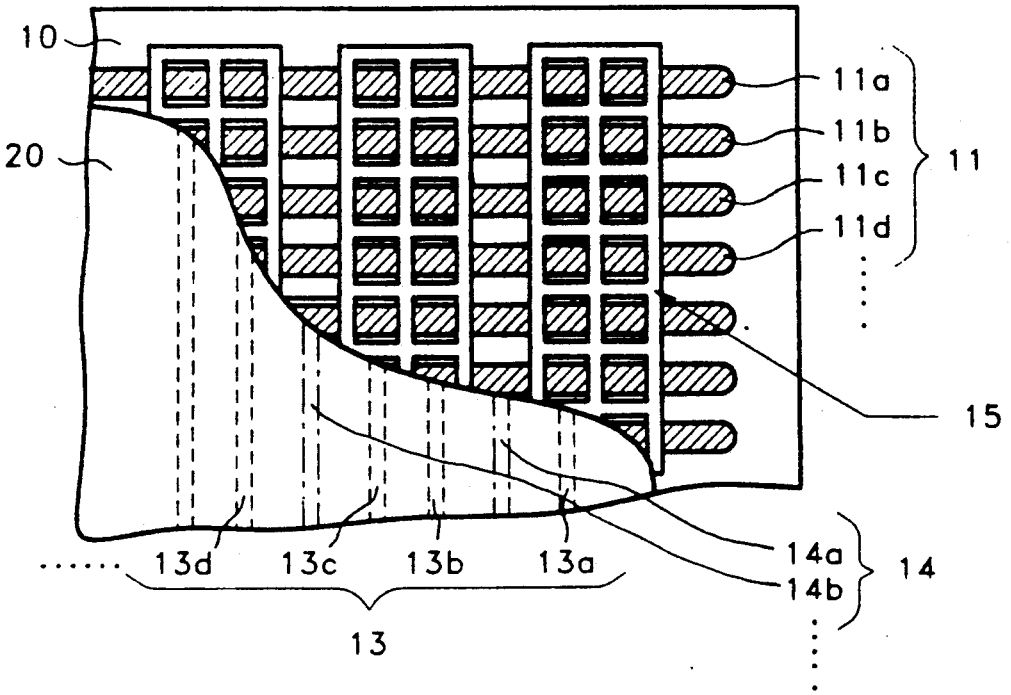
FIG. 1 PRIOR ART
FIG. 1 is a partially sectional plan view showing a conventional PDP of a pulse memory type.
Figure 2:
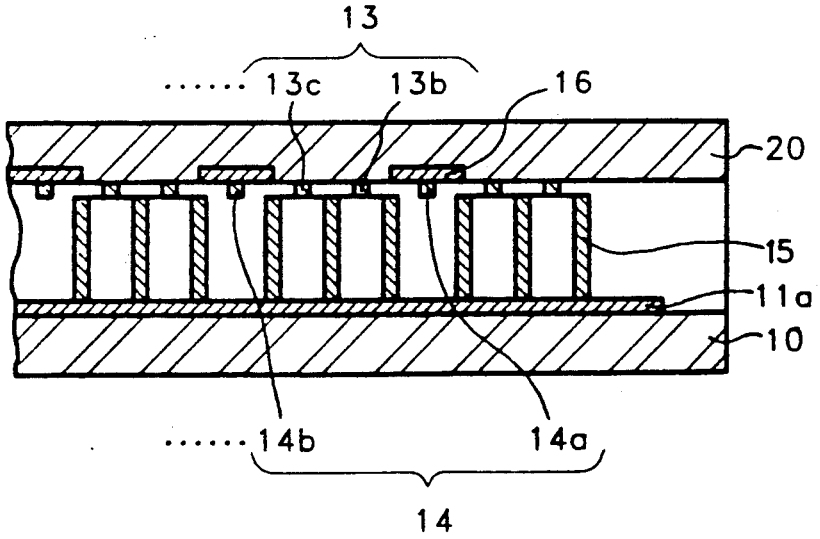
FIG. 2 PRIOR ART
FIG. 2 is a cross sectional view of FIG. 1.
Figure 3:
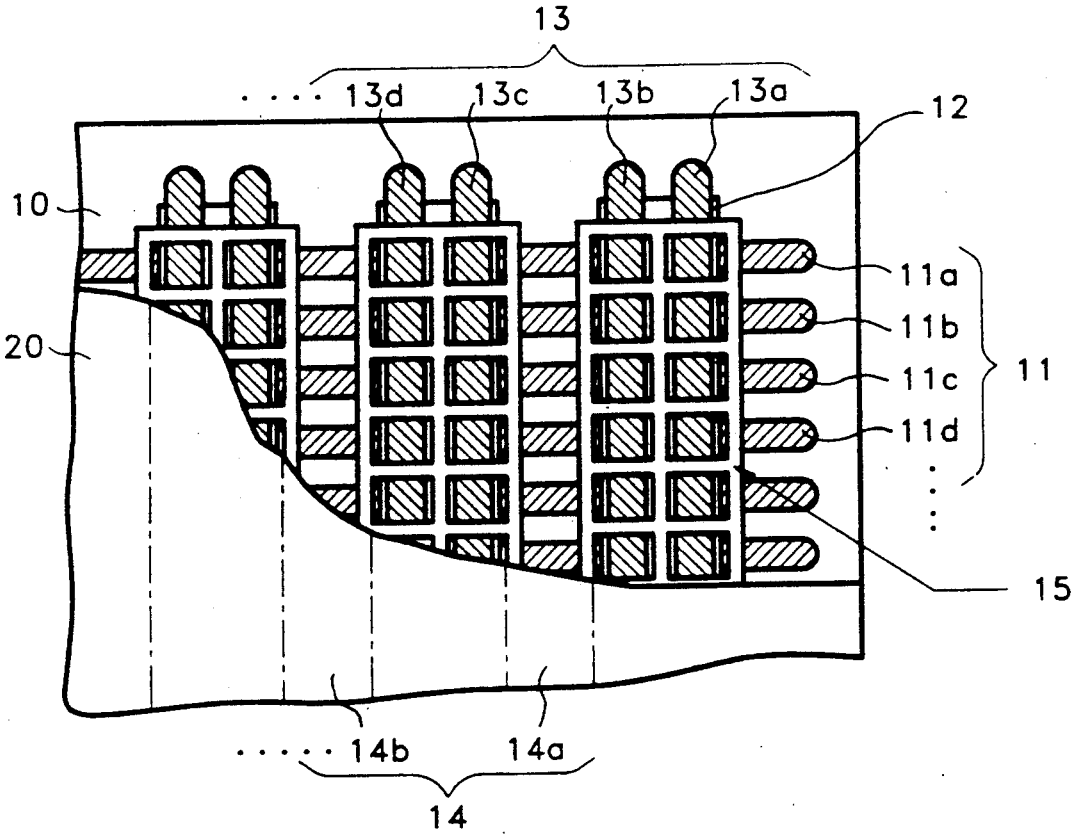
FIG. 3 is a partially sectional plan view showing a PDP of a pulse memory type according to the present invention.
Figure 4:
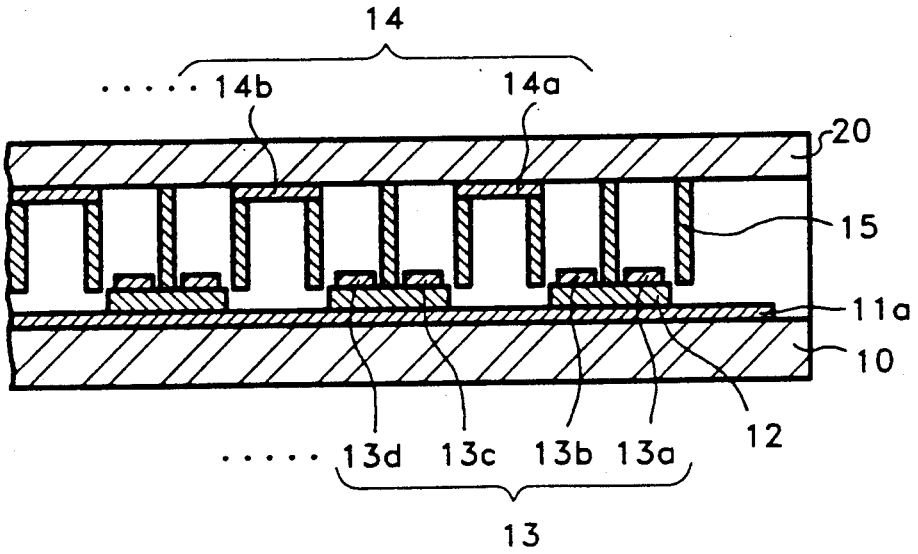
FIG. 4 is a cross sectional view of FIG. 3.

FIG. 3 is a partially sectional plan view of a PDP according to the present invention, and FIG. 4 is a cross sectional view of FIG. 3.

As illustrated in FIGS. 3 and 4, the PDP according to the present invention is constructed in such a manner that a display cathode array 11 is arranged as a plurality of elongated electrode strips on the inner surface of a rear plate 10, a plurality of dielectric layers 12 having a prescribed width are arranged over the cathode array 11 perpendicular to the direction of the cathode array electrodes on the inner surface of the rear plate, and an array of pairs of display anodes 13 are formed over layers 12 as elongated strips to intersect the cathode array 11 at a right angle.

On the other hand, an auxiliary anode array 14 is formed on the inner surface of the face plate 20 as elongated strips intersecting the cathode array 11 in opposed relation. In the above described structure, the display anode array is not formed on the face plate so that the display and the auxiliary anode arrays are not adjacently disposed on the face plate, making it possible to prevent the interference caused by electric field as in the conventional structure. A plurality of latticed barrier ribs 15 for forming display discharge cells and auxiliary discharge cells are also disposed on the inner surface of the face plate 20 on which the auxiliary anode array 14 is arranged. The latticed barrier ribs 15 form paths for charged gas particles between the auxiliary discharge space and the display discharge space at the lower portion of the discharge space near the rear plate 10 as shown in FIG. 4. In more detail, the barrier ribs 15 for separating the display discharge cells from one another are formed in contact with the dielectric layers 12, and the remaining barrier ribs for separating the display discharge cells from the auxiliary discharge cells are formed to be spaced apart from the cathodes of the cathode array 11 by an amount equal to the thickness of the dielectric layer 12. Consequently, the space between the barrier ribs and the dielectric layer 12 is utilized as the path for charged gas particles from the auxiliary to the display discharge space. In this case, the light emitted from the auxiliary discharge cell has little influence upon the adjacent display discharge cells due to the incident angle of the light, thus, the contrast ratio is not degraded by the auxiliary discharge. Alternatively, if a lowered contrast ratio caused by the auxiliary discharge does not cause a problem, the barrier ribs can be arranged on the rear plate to form the charged particle path on the upper portion of the discharge space as in the conventional method for easier process in manufacturing. It is preferable that the thickness of the dielectric layer 12 is of about 30 of 40 μm. To obtain a color PDP, a phosphor layer can be formed on the inner surface of the face plate 20 corresponding to the display discharge cell. Here, all of the foregoing elements are formed by a thick screen printing technique.

The rear plate 10 and the face plate 20 constructed in the above described manner are then superposed in opposing relation and sealed along their peripheral edges after injecting discharge gas under a prescribed vacuum state.

The operation and effect of the present invention having the aforesaid structure are as follows.

Referring to FIG. 4, if a voltage pulse is applied between the display cathode 11*a* and the auxiliary anode 14*a*, an infinitesimal discharge is generated for a designated pixel, thereby forming charged gas particles. In the charged particles are sequentially moved toward the adjacent display discharge space through the charged particle path. When this happens, if display information (voltage) is written on or applied to the display anode 13*a*, the display discharge is easily generated in the selected pixel by the priming effect of the auxiliary discharge.

In the PDP according to the present invention, the effective light emission area is increased by forming the display anode array on the inner surface of the rear plate with the improved result of enhancing the brightness as compared with the conventional PDP.

Moreover, the display anodes and the cathode array are arranged on the inner surface of the rear plate and initiate area discharge, therefore, the erroneous discharge which is generated by variation between the display anodes and the cathode array can be prevented.

In addition, if a wide anode is adopted for supplying large currents, the formation of the electrode is easily performed without any difficulties arising from restrictions imposed by the required effective light emission area, as the anodes are formed on the inner surface of the rear plate.

Furthermore, the contrast ratio is not degraded by the auxiliary discharge, since the path of charged gas particles is formed at the lower portion of the discharge space.

What is claimed is:

1. A plasma display panel, comprising:

a rear plate;

a transparent faceplate opposing said rear plate to form a sealed gas discharge space therebetween;

a cathode array arranged as a plurality of elongated electrode strips formed on an inner surface of said rear plate;

a dielectric layer arranged as a plurality of elongated dielectric strips formed over said cathode array in a direction intersecting said cathode electrode strips at a right angle;

a display anode array arranged as a plurality of elongated electrode strips formed over said dielectric layer strips;

a plurality of barrier ribs formed on said faceplate and extending into said sealed gas discharge space toward said rear plate to form a plurality of display discharge cells and auxiliary discharge cells adjacent said display discharge cells; and an auxiliary anode array arranged as a plurality of elongated electrode strips formed on an inner surface of said faceplate at positions corresponding to said auxiliary discharge cells;

said barrier ribs forming a charged gas particle path between auxiliary discharge cells and adjacent display discharge cells at the lower portion of said sealed gas discharge space toward said rear plate.

2. A plasma display panel according to claim 1, wherein said charged gas particle path has a width equal to the thickness of said dielectric layer.

3. A plasma display panel according to claim 2, wherein the thickness of said dielectric layer is in the range of 30 to 40 μm.

4. A plasma display panel according to claim 1, wherein said display anode electrode strips are arranged in pairs over said dielectric layer strips, and predetermined ones of said barrier ribs extending from said faceplate and contacting said dielectric layer strips between each display anode electrode of said pairs.

* * * * *

UNITED STATES PATENT AND TRADEMARK OFFICE

CERTIFICATE OF CORRECTION

PATENT NO. : 5,093,603

DATED : March 3, 1992

INVENTOR(S) : Seong-hun Kim et al

It is certified that error appears in the above-identified patent and that said Letters Patent is hereby corrected as shown below:

Column 3, line 45, before "the", insert --turns --.

Signed and Sealed this

Third Day of August, 1993

*Attest:*

Michael K. Kirk

MICHAEL K. KIRK

*Attesting Officer*

*Acting Commissioner of Patents and Trademarks*